US006196191B1

(12) United States Patent
Rembold et al.

(10) Patent No.: US 6,196,191 B1
(45) Date of Patent: Mar. 6, 2001

(54) FUEL INJECTION DEVICE FOR INTERNAL COMBUSTION ENGINES

(75) Inventors: Helmut Rembold, Stuttgart; Andreas Kellner, Moeglingen, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/331,484

(22) PCT Filed: Jun. 6, 1998

(86) PCT No.: PCT/DE98/01538

§ 371 Date: Jun. 22, 1999

§ 102(e) Date: Jun. 22, 1999

(87) PCT Pub. No.: WO99/20894

PCT Pub. Date: Apr. 29, 1999

(30) Foreign Application Priority Data

Oct. 22, 1997 (DE) ..... 197 46 563

(51) Int. Cl.[7] ..... F02M 7/00
(52) U.S. Cl. ..... 123/447; 123/456
(58) Field of Search ..... 123/447, 456, 123/458, 514, 511, 179.17, 198 D

(56) References Cited

U.S. PATENT DOCUMENTS

| | | | | |
|---|---|---|---|---|
| 5,441,026 | * | 8/1995 | Akimoto | 123/198 D |
| 5,537,980 | * | 7/1996 | Yamamoto | 123/447 |
| 5,558,068 | * | 9/1996 | Kunishima et al. | 123/516 |
| 5,626,114 | * | 5/1997 | Kushida et al. | 123/198 D |
| 5,758,622 | * | 6/1998 | Rembold et al. | 123/456 |

* cited by examiner

*Primary Examiner*—Noah P. Kamen
*Assistant Examiner*—Mahmond M Gimie
(74) *Attorney, Agent, or Firm*—Ronald E. Greigg; Edwin E. Greigg

(57) ABSTRACT

A fuel injection system for internal combustion engines, having a high-pressure fuel pump which fills a high-pressure collection chamber with high fuel pressure. Injection lines lead away from the high pressure collection chamber to the individual injection valves. A prefeed pump that feeds fuel from a tank via a low-pressure line system into a work chamber of the high-pressure pump, and at least one control valve controls the high-pressure pumping quantity of the high-pressure pump. Control valves are inserted into the low-pressure line system that adjust the fuel filling flow into the work chamber of the high-pressure pump to the fill volume actually required for operation.

20 Claims, 2 Drawing Sheets

FUEL INJECTION DEVICE FOR INTERNAL COMBUSTION ENGINES

PRIOR ART

The invention is based on a fuel injection system for internal combustion engines as. In one such fuel injection system for internal combustion engines, known from the professional journal "mot", No. 13 (1997), Jun. 7, 1997, page 62, a high-pressure pump fills a high-pressure collection chamber (common rail) with fuel at high pressure from a tank. From this high-pressure collection chamber, which is preferably formed by a distributor strip, all the injection lines lead away to the individual injection valves. The high-pressure fuel pump is supplied with fuel from a fuel tank by means of a prefeed pump, which via a low-pressure line system pumps into a work chamber of the high-pressure pump. In the known fuel injection system, a control valve is inserted into the low-pressure line system to control the high-pressure pumping quantity of the high-pressure pump. This control valve controls the flow from a low-pressure feed line into the work chamber of the high-pressure pump, and a high-pressure line leads away from the pump side of this feed line to the high-pressure collection chamber. Adjusting the high-pressure pumping quantity at the high-pressure feed pump is now done by closing the overflow cross section between the part of the line leading away from the pump work chamber into the low-pressure line system during the pumping stroke phase of the high-pressure feed pump. The prefeed pump uninterruptedly supplies the pump work chamber with fuel, and the fuel first passes through the control valve in the low-pressure line system. At the onset of the pumping stroke motion of the high-pressure feed pump, the control valve remains open, so that initially some of the fuel located in the pump work chamber is forced back into the low-pressure line system. If high-pressure pumping is to be done at the high-pressure pump, the control valve closes the overflow cross section into the low-pressure line system, so that in the further course of the pumping stroke motion of the high-pressure pump, a high fuel pressure is then built up in the pump work chamber and is carried on into the high-pressure collection chamber via the pressure line. The control of the high-pressure pumping quantity is effected via the instant of closure of the overflow cross section from the pump work chamber into the low-pressure operating system by means of the control valve; the high-pressure pumping quantity decreases, the later the control valve closes this overflow cross section, and vice versa.

The known fuel injection system for internal combustion engines has the disadvantage, however, that the entire fuel quantity pumped by the prefeed pump first flows into the work chamber of the high-pressure pump, and then at least some of it is positively displaced back into the low-pressure line system. In this initial expulsion of the fuel from the work chamber of the high-pressure pump, an unnecessary mass motion of fuel takes place, which unnecessarily lessens the efficiency of the high-pressure feed pump.

ADVANTAGES OF THE INVENTION

The fuel injection system for internal combustion engines according to the invention has the advantage over the prior art that the prefeed pump actually fills the pump work chamber of the high-pressure feed pump with only the fuel quantity needed at that moment, so that an unnecessary additional positive displacement work on the part of the pump pistons of the high-pressure feed pump can be avoided. This pumping flow filling control of the pump work chamber of the high-pressure feed pump as needed is achieved in a structurally simple way via control means in the low-pressure circuit filled by the prefeed pump. The low-pressure circuit is advantageously divided, in a first exemplary embodiment, into three branches which are jointly filled with fuel by the prefeed pump, preferably embodied as an electric fuel feed pump. A first branch is formed by a feed line to the pump work chamber of the high-pressure feed pump, into which line a constant pressure regulating valve is inserted. A second branch forms a lubricant oil line, which flows through a driving gear chamber of the pump drive of the high-pressure feed pump and in the process lubricates and cools the pump. This lubricant oil line preferably has a return flow throttle restriction downstream of the pump driving gear and discharges into the tank via a return line that forms the third branch. An electric pressure control valve, preferably a magnet valve, is intended into this return line into the tank. This electric pressure control valve in cooperation with the constant pressure valve in the feed line to the high-pressure pump forms the control means by way of which the degree of filling of the pump work chamber of the high-pressure pump can be adjusted. The holding pressure or minimum opening pressure of the electric pressure control valve in the return line is embodied as less than the opening pressure of the constant pressure valve in the feed line to the high-pressure pump and at the same time is greater than the flow resistance in the lubricant oil line. In this way, a reliable flow through the lubricant oil line and thus reliable cooling and lubrication of the pump driving gear are assured. In FIG. 2, a further advantageous exemplary embodiment is shown, in which the low-pressure circuit has only two branches. Here part of the feed line into the pump work chamber of the high-pressure feed pump forms the lubricant oil line through the pump driving gear. The electric pressure control valve is inserted into the feed line between the pump driving gear and the pump work chamber. The mechanical constant pressure valve required to set a certain standard pressure is inserted into the return line into the tank. A further advantage is attained by the additional provision of a bypass line between the feed side of the prefeed pump and the high-pressure collection chamber, into which line a check valve opening in the direction of the high-pressure collection chamber is inserted. In this way, when the engine to be supplied is started, a rapid pressure buildup in the high-pressure collection chamber is attained, and the injection pressure in the high-pressure collection chamber can be set to the maximum available value from the prefeed pump. In order to prevent flow losses via the lubricant oil line, it is advantageous to dispose a so-called flow limiter in series with the throttle restriction in the lubricant oil line; beyond a certain maximum flow, the flow limiter breaks the connection with the tank. For rapid pressure relief of the fuel injection system after the engine is turned off, it is furthermore advantageous to provide a 2/2-way magnet control valve in a relief line of the high-pressure collection chamber that discharges into the tank. Via a throttle upstream of this valve, the pressure can also be rapidly decreased when the control valve is open. In systems with variable injection pressure, a rapid adaptation to a lower pressure level is also possible. In order to avert the risk of overheating of the high-pressure pump, which exists because of the low pumping flow at high ambient temperatures and low injection quantities or high-pressure pumping quantities, the control valve in the relief line of the high-pressure collection chamber is opened purposefully during the pauses between injections if the ambient or fuel temperature exceeds a predetermined value. The resultant increase in the pumping flow into the pump work chamber of the high-pressure pump then assures sufficient cooling of the high-pressure pump.

Further advantages and advantageous features of the subject of the invention can be learned from the description, drawing and claims.

BRIEF DESCRIPTION OF THE DRAWINGS

Three exemplary embodiments of the fuel injection system of the invention are shown in the drawings and will be described in further detail below.

DESCRIPTION OF THE EXEMPLARY EMBODIMENTS

Figure 1:
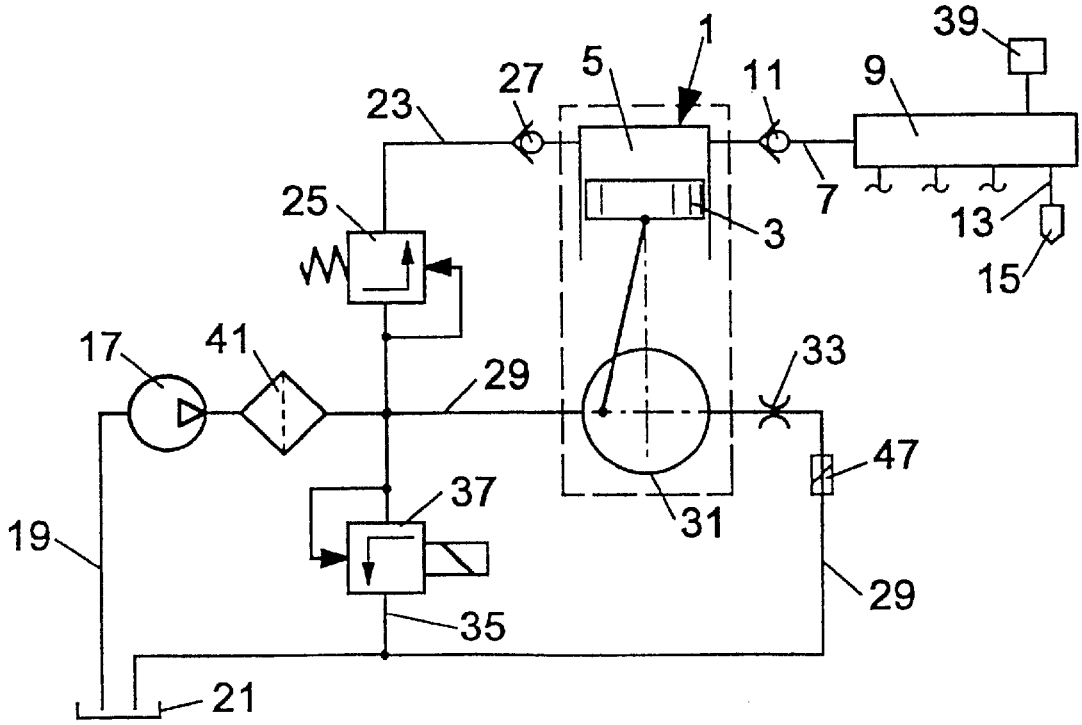
FIG. 1 shows a simplified basic sketch of a first exemplary embodiment, in which the low-pressure circuit has three branches.

The first exemplary embodiment, schematically shown in FIG. 1, of the fuel injection system according to the invention has a high-pressure fuel pump 1, in which an axially reciprocatingly driven pump piston 3, with its end face, defines a pump work chamber 5. Leading away from this pump work chamber 5 is an injection line 7, which on the other end discharges into a high-pressure collection chamber 9; an outlet check valve 11 opening in the direction of the high-pressure collection chamber 9 is inserted into the injection line 7. From the high-pressure collection chamber (common rail distributor strip), injection lines 13 lead away to the individual injection valves 15. These injection valves can discharge either directly into the combustion chambers of the individual cylinders of the engine to be supplied, or alternatively into the intake conduits of these cylinders.

For fuel supplied by the high-pressure feed pump 1, a low-pressure prefeed pump 17 is also provided, which pumps fuel out of a tank 21 via an intake line 19. The prefeed pump 17 pumps on the pressure side into a low-pressure circuit, which in the first exemplary embodiment has three branch lines that can be filled jointly with fuel by the prefeed pump 17. A first branch forms a feed line 23 to the high-pressure pump 1 and discharges there into the pump work chamber 5. A mechanically adjustable constant pressure valve 25 is inserted into this feed line 23, and in addition an inlet check valve 27 is inserted at the discharge point into the pump work chamber 5. A second branch from the feed side of the prefeed pump 7 forms a lubricant oil line 29, which flows through a driving gear 31, preferably a piston drive, that drives the high-pressure pump 1. After emerging from the driving gear 31, the lubricant oil line 29 (coolant oil line) discharges into the tank 21, and a return throttle restriction 33 is provided in the lubricant oil line 29 downstream of the driving gear 31. A third branch of the low-pressure line system is formed by a return line 35, which discharges jointly with the lubricant oil line 29 into the tank 21, and into which an electrically triggerable pressure control valve 37 is inserted. This pressure control valve 37 is preferably embodied as a magnet-valve-controlled control valve.

For monitoring the pressure in the high-pressure collection chamber 9, a pressure 39 can also be provided there. A fuel filter 41 is also inserted into the low-pressure line system, preferably near the feed-side exit from the prefeed pump 17.

The first exemplary embodiment of the fuel injection system of the invention functions as follows. With the onset of operation of the engine to be supplied, the prefeed pump 17 makes the volumetric flow required to operate the high-pressure feed pump 1 available. To that end, the prefeed pump 17 pumps fuel out of the tank 21 via the intake line 19 into the individual partial lines 23, 29 and 35 of the low-pressure line system. The minimum holding pressure or minimum opening pressure of the electric control valve 37 in the return line 35 is designed such that in the currentless state, a predetermined pressure (preferably approximately 0.3 bar) still drops so as to assure a minimum flow through the lubricant oil line 29 and the driving gear 31. This lubricating oil or coolant pumping flow in the lubricant oil line 29 for the pump driving gear 31 is determined by the pilot pressure built up and by the cross section of the return throttle 33. The opening pressure of the constant pressure valve 25 in the feed line 23 is above the minimum holding pressure of the electric control valve 37.

Alternatively, the elevated opening pressure of the constant pressure valve 25 can also be achieved directly in the inlet valve 27 of the high-pressure pump 1. Using the additional pressure valve 25 is especially advantageous whenever filling differences in a multipiston pump are to be avoided, differences that can be caused by tolerances in the opening pressure of the inlet valves.

In partial-load engine operation, the pilot pressure in the low-pressure circuit is now set, via the electrically adjustable pressure control valve 37, in such a way that in accordance with the pressure difference at the constant pressure valve 25 (an opening pressure preferably of approximately 0.5 bar), precisely the fuel quantity required for injection can pass through and flows into the pump work chamber 5. The opening pressure of the inlet check valve 27 is below the opening pressure of the db 25. The fuel quantity that flows into the pump work chamber 5 of the high-pressure pump 1 during the interval between injections is now compressed during the pumping stroke in the direction of top dead center of the pump piston. 3, and once a certain injection pressure value is exceeded, it flows over, via the outlet check valve 11, into the high-pressure collection chamber 9. There, the high fuel pressure is propagated via the injection lines 13 to the respective injection valves 15, where it is brought to injection in a known, controlled manner.

The fuel vapor that occurs during the intake phase because of the negative quantitative balance in the pump work chamber 5 in the partial-load range is recondensed in the ensuing pumping stroke of the pump piston 3. By setting a defined opening pressure at the inlet check valve 27 of the high-pressure pump 1, it is assured that the creation of fuel vapor remains limited to the pump work chamber 5, which guarantees a replicable pumping flow of the high-pressure pump 1. If the injection quantity at the injection valves 15, and thus the high-pressure fuel quantity to be pumped by the high-pressure pump 1, is to be increased, then the opening pressure at the electric pressure control valve is increased accordingly, so that a larger pumping quantity from the prefeed pump 17 reaches the pump work chamber 5 of the high-pressure pump 1 via the feed line 23. The return throttle 33 prevents an uncontrolled outflow of pumped fuel via the lubricant oil line 29. The pumping quantity pumped into the pump work chamber 5 can thus be adjusted individually from one injection to another via the opening pressure of the electric pressure control valve 37, as a function of the opening pressure of the pressure valve 25.

Figure 2:
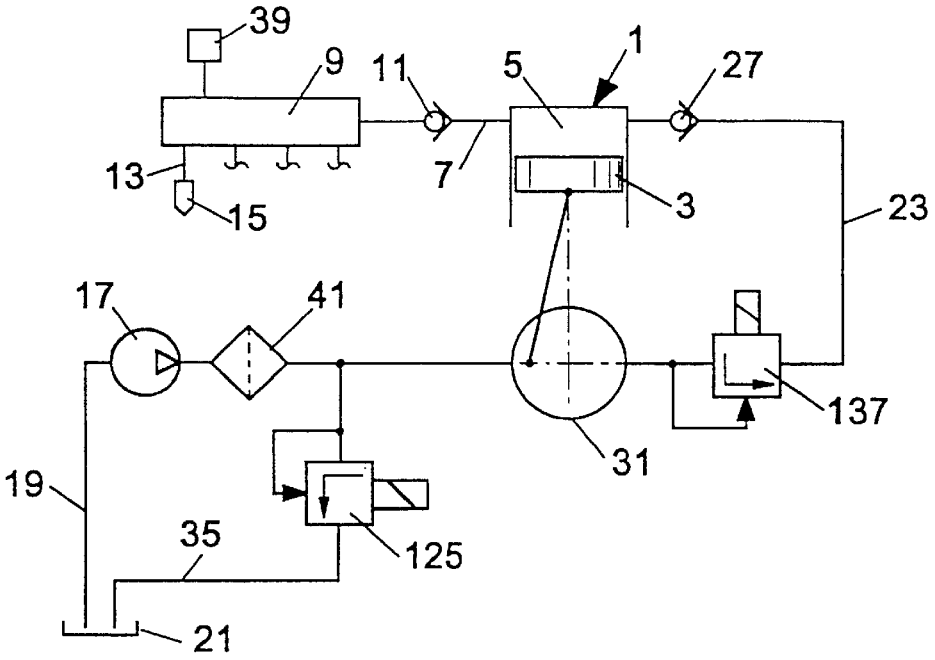
FIG. 2 shows a second exemplary embodiment, in which the low-pressure circuit has two branches.

The second exemplary embodiment, shown in FIG. 2, of the fuel injection system for internal combustion engines of the invention differs from the first exemplary embodiment in the embodiment of the low-pressure line system, which now has only two branches leading away from the prefeed pump 17. One branch is again formed by a return line 35 into the tank 21, and a constant pressure valve 125 is now inserted into this return line 35. The second branch is formed by the feed line 23 to the high-pressure pump 1, and the feed line 23 flows through the driving gear 31 of the high-pressure pump 1 and thus jointly acts as part of the original lubricant oil line. An electric pressure control valve 137 is inserted between the driving gear 31 and the pump work chamber 5 of the high-pressure pump 1, and it is adjoined, shortly before the discharge point of the feed line 23 into the pump work chamber 5, by an internal combustion engine 27 that opens in the direction of the pump work chamber 5.

The function of the second exemplary embodiment is analogous to the first exemplary embodiment; the control of filling of the pump work chamber 5 is again effected via the electric pressure control valve 137 as a function of the differential opening pressure of the pressure valve 125, in such a way that only the quantity of fuel required at that moment is fed into the pump work chamber 5. The excess fuel quantity pumped by the prefeed pump 17 is returned to the tank 21 via the return line 35. This system, without a return line from the pump driving gear 31 to the tank, is preferably suitable for use in direct-injection internal combustion engines with externally supplied ignition, so as to prevent any additional heating of the tank volume and thus an increased load on the tank venting system.

Figure 3:
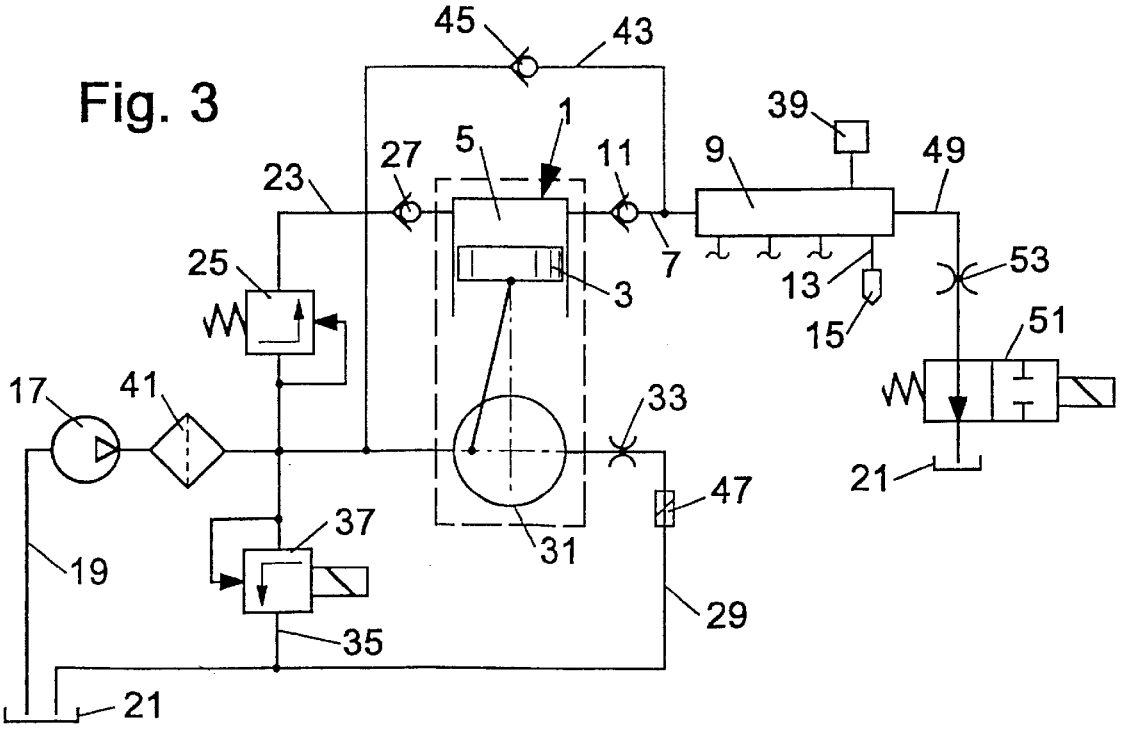
FIG. 3 shows a third exemplary embodiment, analogous to FIG. 1, in which in addition a bypass line is provided between the prefeed pump and the high-pressure collection chamber.

The third exemplary embodiment, shown in FIG. 3, of the fuel injection system for internal combustion engines according to the invention has the same basic layout as the first exemplary embodiment described in FIG. 1 and is merely expanded with two further functions. The fuel injection system of FIG. 3 has an additional bypass line 43, which beginning at the pumping pressure side region of the low-pressure line system discharges into the high-pressure collection chamber 9. A check valve 45 opening in the direction of the high-pressure collection chamber 9 is inserted into this bypass line 43. The bypass line 43 makes it possible to fill the high-pressure collection chamber 9 directly by the prefeed pump 17, so that when the engine to be supplied is started, the injection pressure in the high-pressure collection chamber 9 can be built up very quickly to the maximum available pressure value from the prefeed pump 17. This is advantageous in injection systems for internal combustion engines with externally supplied ignition, since when the engine is started, the pressure buildup in the high-pressure collection chamber 9 can be delayed by inclusions of gas or air in the high-pressure circuit. The injection pressure required for injection can now be adjusted very quickly to the maximum available value from the prefeed pump 17. To make it possible to avoid flow losses via the lubricant oil line 29, it is advantageous to dispose a flow limiting valve 47 (or flow limiter) in the lubricant oil line 29, in series with the return throttle 33; beyond a certain flow value, this flow limiter breaks the connections with the tank 21.

The third exemplary embodiment shown in FIG. 3, in a supplement to the first exemplary embodiment shown in FIG. 1, also has an additional relief line 29 of the high-pressure collection chamber 9, and this line discharges into a tank 21. An electrically triggerable 2/2-way control valve 51, preceded in the flow direction by a throttle restriction 53, is inserted into this relief line 49. Thus via this relief line 49, the pressure in the high-pressure collection chamber 9 can advantageously be decreased quickly after the engine is turned off. Furthermore, particularly in injection systems with variable injection pressure, a rapid adaptation of the pressure in the high-pressure collection chamber 9 to a lower pressure level is possible. In order at high ambient temperatures and low injection quantities to counteract the risk that the high-pressure feed pump 1 will run hot because of the small pumping flow quantities, the 2/2-way control valve 51 can open the relief line during the intervals between injection if the ambient or fuel temperature exceeds a predetermined value. The increase, resulting from this pressure relief in the high-pressure collection chamber 9, in the filling pumping flow into the pump work chamber 5 of the high-pressure pump 1 makes additional cooling of the high-pressure pump 1 possible. The 2/2-way valve 51, embodied as a magnet valve, is switched such that in its currentless state, the flow cross section to the tank 21 is opened up.

With the fuel injection system for internal combustion engines of the invention, it is thus possible, by suitable control in the low-pressure line system, to adjust the degree of filling of the pump work chamber 5 of the high-pressure pump 1 to the fuel volume actually needed at that moment, so that excessive positive displacement work on the part of the high-pressure pump 1 can be avoided. The fuel injection system of the invention is suitable for supplying both internal combustion engines with externally supplied ignition and self-igniting internal combustion engines.

The foregoing relates to preferred exemplary embodiments of the invention, it being understood that other variants and embodiments thereof are possible within the spirit and scope of the invention, the latter being defined by the appended claims.

What is claimed is:

1. A fuel injection system for internal combustion engines, comprising a high-pressure fuel pump (1) which fills a high-pressure collection chamber (9) with high fuel pressure, from the high-pressure collection chamber, injection lines (13) lead away from the collection chamber to individual injection valves (15), a prefeed pump (17) that pumps fuel from a tank (21) via a low-pressure line system into a work chamber (5) of the high-pressure pump (1), at least one control valve for controlling the high-pressure pumping quantity of the high-pressure pump (1), adjustable constant pressure valve means (25) is inserted into the low-pressure line system that adjust the fuel filling flow into the work chamber (5) of the high-pressure pump (1) to the fill volume required for operation.

2. The fuel injection system according to claim 1, in which the low-pressure line system has three branches, each of said three branches are filled jointly by the prefeed pump (17), of which a first branch forms a feed line (23) to the high-pressure pump (1), a second branch forms a lubricant oil line (29) into the driving gear (31) that drives the high-pressure pump (1), and a third branch forms a return line (35) into the tank (21), and the lubricant oil line (29), after emerging from the driving gear (31), discharges into the tank (21).

3. The fuel injection system according to claim 2, in which an electric pressure control valve (37) is inserted into the return line (35), and at least one further pressure valve (25) is inserted into the feed line (23) to the high-pressure pump (1), and these valves form the control means for filling the work chamber (5) of the high-pressure pump (1).

4. The fuel injection system according to claim 3, in which the pressure valve (25) in the feed line (23) is embodied as a constant pressure valve.

5. The fuel injection system according to claim 3, in which a further pressure valve is inserted into the feed line (23), preferably near the discharge point into the work chamber (5) of the high-pressure pump (1), and is embodied as a check valve (27) that opens in the direction of the high-pressure pump (1).

6. The fuel injection system according to claim 2, in which the lubricant oil line (29) has a throttle restriction (33) downstream of the pump driving gear (31).

7. The fuel injection system according to claim 3, in which the lubricant oil line (29) discharges into the return line (35) downstream of the electric pressure control valve (37).

8. The fuel injection system according to claim 2, in which a high-pressure line (7) leads away from the work chamber (5) of the high-pressure pump (1), and discharges into the high-pressure collection chamber (9), and a check valve (11) opening in the direction of the high-pressure collection chamber (9) is inserted into said high-pressure collection line.

9. The fuel injection system according to claim 3, in which the opening pressure of the pressure valve (25) in the feed line (23) to the high-pressure pump (1) is greater than the minimum opening pressure of the electric pressure control valve (37).

10. The fuel injection system according to claim 3, in which the minimum opening pressure of the electric pressure control valve (37) is greater than the flow resistance in the lubricant oil line (29).

11. The fuel injection system according to claim 1, in which the low-pressure line system has two branches filled jointly by the prefeed pump (17), of which a first branch forms a feed line (23) to the high-pressure pump (1) and a second branch forms a return line (35) into the tank (21).

12. The fuel injection system according to claim 11, in which the feed line (23) flows through a driving gear (31) that drives the high-pressure pump (1).

13. The fuel injection system according to claim 12, in which an electric pressure control valve (137) is inserted into the feed line (23) between the pump driving gear (31) and the discharge point of the feed line (23) into the work chamber (5) of the high-pressure pump (1).

14. The fuel injection system according to claim 13, in which a check valve (27) opening in the direction of the work chamber (5) of the high-pressure pump (1) is inserted into the feed line between the electric pressure control valve (137) and the discharge point into the work chamber (5) of the high-pressure pump (1).

15. The fuel injection system according to claim 11, in which a pressure valve (125) is inserted into the return line (35).

16. The fuel injection system according to claim 2, in which an additional bypass line (43) is provided between the feed side of the prefeed pump (17) and the high-pressure collection chamber (9), a check valve (45) opening in the direction of the high-pressure collection chamber (9) is inserted into said bypass line.

17. The fuel injection system according to claim 11, in which an additional bypass line (43) is provided between the feed side of the prefeed pump (17) and the high-pressure collection chamber (9), a check valve (45) opening in the direction of the high-pressure collection chamber (9) is inserted into said bypass line.

18. The fuel injection system according to claim 1, in which a relief line (49) leads away from the high-pressure collection chamber (9) into the tank (21), and an electric control valve (51) is inserted into said relief line (49).

19. The fuel injection system according to claim 18, in which the electric control valve (51) of the relief line (49) is preceded in the flow direction by a throttle restriction (53).

20. The fuel injection system according to claim 1, in which a fuel filter (41) is inserted into the low-pressure line system, near an exit from the prefeed pump (17).

* * * * *